US007731044B2

(12) United States Patent
Boukobza

(10) Patent No.: US 7,731,044 B2
(45) Date of Patent: Jun. 8, 2010

(54) THERMOPLASTIC CONTAINER ADAPTED TO BE FILLED WITH A HOT LIQUID

(75) Inventor: Michel Boukobza, Octeville sur Mer (FR)

(73) Assignee: Sidel Participations, Octeville sur Mer (FR)

( * ) Notice: Subject to any disclaimer, the term of this patent is extended or adjusted under 35 U.S.C. 154(b) by 266 days.

(21) Appl. No.: 11/886,489

(22) PCT Filed: Mar. 14, 2006

(86) PCT No.: PCT/FR2006/000560

§ 371 (c)(1),
(2), (4) Date: Sep. 17, 2007

(87) PCT Pub. No.: WO2006/100365

PCT Pub. Date: Sep. 28, 2006

(65) Prior Publication Data

US 2008/0105645 A1 May 8, 2008

(30) Foreign Application Priority Data

Mar. 18, 2005 (FR) ..... 05 02728

(51) Int. Cl.
*B65D 1/40* (2006.01)
*B65D 1/46* (2006.01)

(52) U.S. Cl. ..... 215/381; 215/382; 220/673; 220/675

(58) Field of Classification Search ..... 215/381, 215/379, 380, 382; 220/666, 673, 675, 669
See application file for complete search history.

(56) References Cited

U.S. PATENT DOCUMENTS

| | | | | | |
|---|---|---|---|---|---|
| 3,357,593 | A | * | 12/1967 | Sears, Jr. et al. | 220/670 |
| 5,054,632 | A | * | 10/1991 | Alberghini et al. | 215/381 |
| 5,704,503 | A | * | 1/1998 | Krishnakumar et al. | 215/381 |
| 5,704,504 | A | | 1/1998 | Bueno et al. | |
| D395,821 | S | * | 7/1998 | Tabaroni et al. | D9/696 |
| 6,036,037 | A | * | 3/2000 | Scheffer et al. | 215/381 |
| 6,497,333 | B1 | * | 12/2002 | Ellis et al. | 215/383 |

(Continued)

FOREIGN PATENT DOCUMENTS

EP 1 038 785 A 9/2000

(Continued)

*Primary Examiner*—Sue A Weaver
(74) *Attorney, Agent, or Firm*—Sughrue Mion, PLLC

(57) ABSTRACT

A thermoplastic container (1) adapted to be filled with a hot liquid, comprising a body (2) having a plurality of recessed panels (3) parallel to the axis (4) of the body and separated by beams (5) parallel to the axis; the panels are arranged on a number of levels (A, B, . . . ), the panels of two consecutive levels being separated by a collar (6) in surface continuity with the beams; each beam is recessed to form a longitudinal central channel section (7), and the channel sections (7) of the beams (5) of the successive levels are connected to one another, in an angularly offset manner from a beam (5) of one level to the consecutive beam (5) of the adjacent level, by strongly inclined channel sections (8) extending in the collars (6), channel sections (7, 8) forming channels configured as parallel successive steps and distributed over the periphery of the body.

9 Claims, 2 Drawing Sheets

U.S. PATENT DOCUMENTS

| | | | | |
|---|---|---|---|---|
| 6,666,001 | B2 * | 12/2003 | Mero | 53/413 |
| 7,080,747 | B2 * | 7/2006 | Lane et al. | 215/381 |
| 7,243,808 | B2 * | 7/2007 | Livingston et al. | 215/381 |
| 2002/0000421 | A1 * | 1/2002 | Ota et al. | 215/381 |

FOREIGN PATENT DOCUMENTS

| | | | |
|---|---|---|---|
| JP | 11 059644 | A | 3/1999 |
| WO | WO 03/008278 | A | 1/2003 |

* cited by examiner

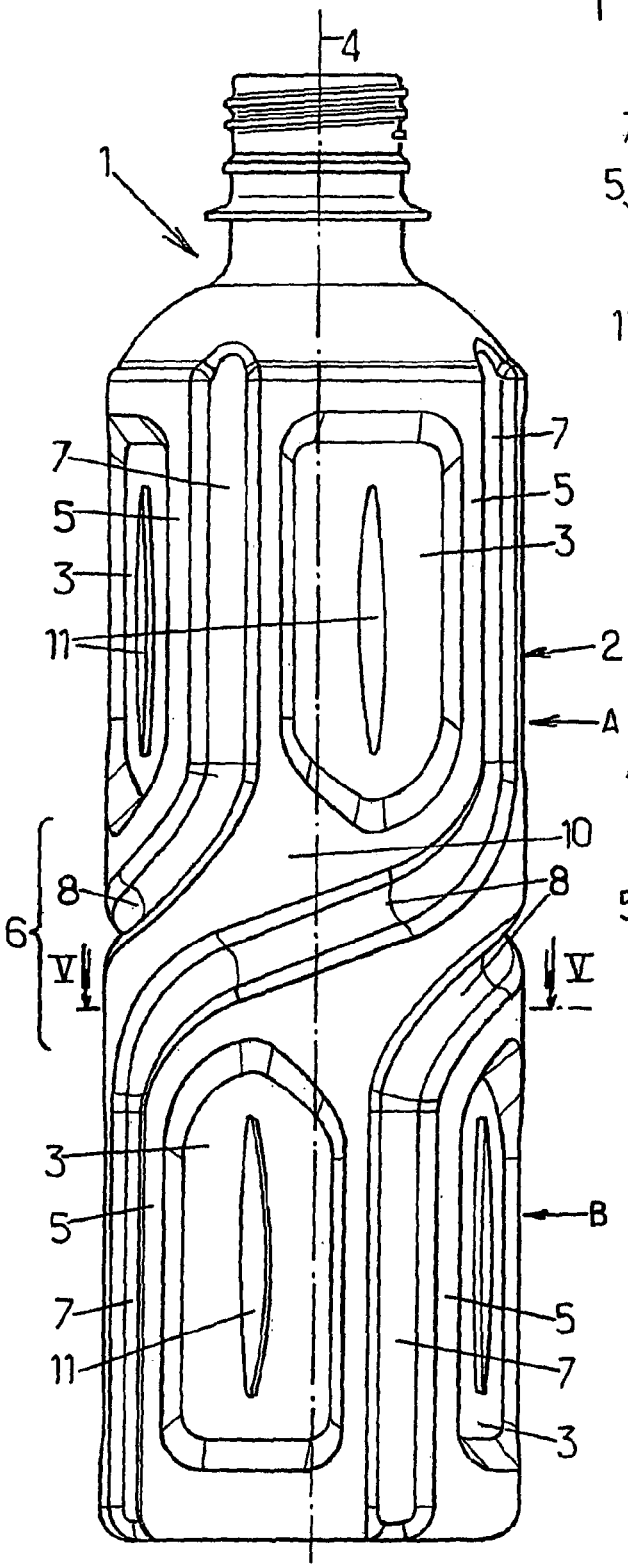
FIG.3.
FIG.4A.
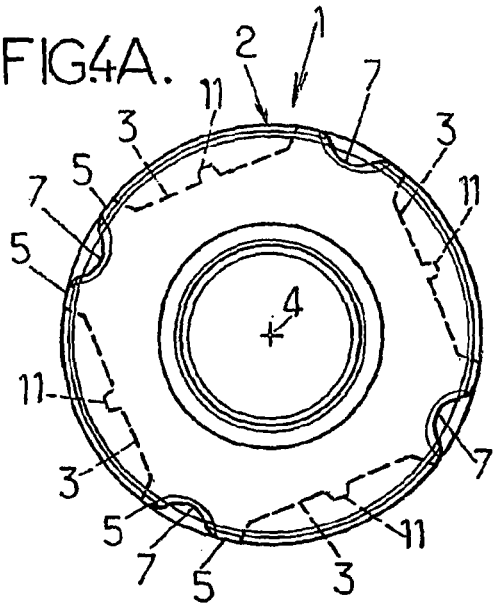
FIG.4B.
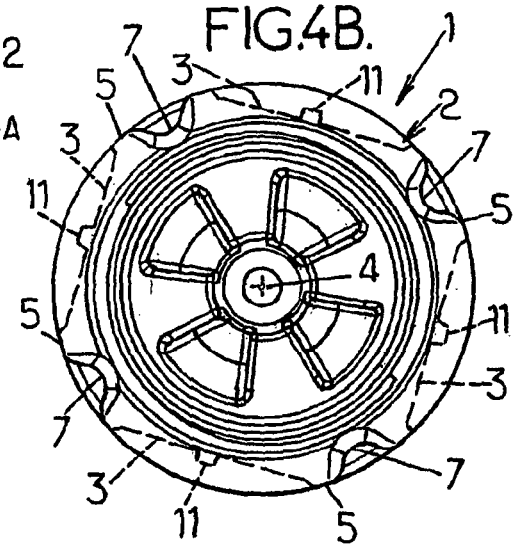
FIG.5.
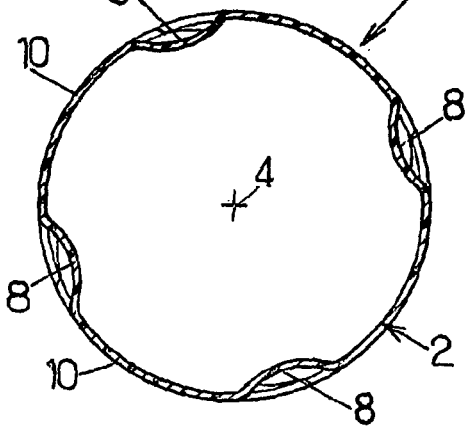

THERMOPLASTIC CONTAINER ADAPTED TO BE FILLED WITH A HOT LIQUID

FIELD OF THE INVENTION

The present invention relates generally to the field of hot-fillable thermoplastic containers, and it relates more specifically to improvements made to the containers, in particular bottles, made of thermo-plastic such as PET, which are adapted to be filled with a hot liquid, these containers comprising a body having a plurality of recessed panels extending substantially parallel to the axis of the body and distributed in a substantially equidistant manner around the body, these panels being separated by portions of the body that form beams extending substantially vertically.

BACKGROUND OF THE INVENTION

In the context of the present invention, the term "hot liquid" is intended to denote a liquid which, at the time it is poured into the container, has a temperature of at least 60° C., and more particularly, although not exclusively, has a temperature within the top of the range, of at least 85° C. and possibly as much as 90-95° C.

It will be recalled that a hot liquid has a substantially greater volume than the volume it occupies when it is cold. Consequently, when a container is filled with a hot liquid and then closed in a sealed manner, the liquid reduces in volume as it cools. owing to the sealing provided by the closure of the container, the reduction in volume of the liquid cannot be compensated for by admitting an equivalent volume of air. Furthermore, a comparable phenomenon occurs with the air contained in the container which, following closure, heats up in contact with the liquid and subsequently cools, with the result that finally its pressure decreases. The container is thus placed under vacuum and is deformed with an inward caving of its walls, particularly the walls of its body. By way of example, in a 1.5-liter container the reduction in volume may be around 5 to 6 cl, this being sufficient to significantly deform the container. Furthermore, as will be readily understood, the degree of reduction in volume of the liquid, and therefore the degree of concomitant deformation of the container, will be greater the higher the temperature of the liquid during filling.

In a container which is not specifically suitable, it is the weakest walls or wall parts which deform, and these deformations cannot be controlled, which means that a container deformed in these circumstances not only has a poor appearance but can also be rendered unstable if its base has been curved.

Moreover, given that a normal and natural physical phenomenon is involved, it is not conceivable to attempt to produce non-deformable containers, something which could only be achieved, insofar as is possible, by providing the walls with considerable thicknesses: this would result in a high consumption of material, and therefore in an excessive cost which is unacceptable in an industrial manufacturing process involving very large quantities. Furthermore, a container thus produced and filled under these conditions would be under vacuum, with a risk of the container bursting, particularly in the event of impact, and/or a risk of liquid spraying out when opening the container.

It is therefore known to produce containers which are specifically configured to be filled with a hot liquid, these containers being provided with parts designed to be able to deform without adversely affecting the shape of the rest of the container, particularly its base. Containers with controlled deformation which keep their general shape and which, above all, remain stable are thus formed. These deformable parts generally take the form of recessed panels provided on the body of the containers, these panels being distributed over the periphery of the body and separated from one another by portions of the body that form non-deformable beams. The panels are often substantially rectangular or approximately rectangular in shape, are possibly provided with reinforcing projections, and are elongated parallel to the axis of the container.

In some cases, such containers have a relatively high degree of deformability in the central region and are not acceptable to be sold.

Furthermore, such panel-type containers have an esthetically questionable appearance.

SUMMARY OF THE INVENTION

The object of the invention is essentially to overcome, as far as is possible, the inadequacies of current containers and to provide an improved structure for a hot-fillable container that makes it possible to design both small-capacity and large-capacity containers having, moreover, an esthetically pleasing appearance.

To these ends, the invention provides a container as mentioned in the preamble which, being configured according to the invention, is characterized in that:

- the panels are arranged on a number of levels around the body;
- the panels of two consecutive levels are separated by an annular portion of the body that forms a collar substantially in surface continuity with said beams; and
- each beam is recessed to form a longitudinal central channel section, and the channel sections of the beams of the successive levels are connected to one another, in an angularly offset manner from a beam of one level to the consecutive beam of the adjacent level, by strongly inclined channel sections extending in said collars and all inclined in the same direction substantially parallel to one another, in such a way that the body is provided, right from top to bottom, with channel sections which, connected together, form channels configured as substantially parallel successive steps and distributed over the periphery of the body.

By virtue of the measures which have just been explained, the annular parts of the body that are constituted by said collars are mechanically reinforced, owing to the inclination of the channel sections situated in these parts, against a crushing force due to the vacuum generated by the restriction in volume of the liquid as it cools.

The strength thus provided is increased the closer these channel sections are to the horizontal. Hence, in order to be able to achieve a relatively prone position for these channel sections, provision is advantageously made, in a preferred embodiment, for the panels of two consecutive levels to be angularly offset such that a panel of one level is situated at least partly opposite a beam of the adjacent level, and for the channel sections of the collar which is situated between these two levels to be inclined in the direction of the aforesaid angular offset of the panels of the two levels, whereby the inclined channel sections of said collar have an increased length in the peripheral direction of the body, and the collar has greater strength.

In a preferred exemplary embodiment, the panels are distributed over two levels, and said collar is the only collar.

Furthermore, provision can be made, on each level, for the panels to alternate with an identical number of beams.

Particularly in the case where these last two measures are combined in the same container, it is desirable for the inclined channel sections of said collar to have an inclination of between 40 and 90°, preferably approximately 70°, with respect to the axis of the body.

BRIEF DESCRIPTION OF THE DRAWINGS

The invention will be better understood on reading the detailed description which follows of specific preferred embodiments given purely by way of non-limiting examples. In this description, reference is made to the appended drawings, in which:

FIG. 3 is a side view of the whole of a container incorporating the arrangements shown in FIG. 2;

FIGS. 4A and 4B are respective top and bottom views of the container shown in FIG. 3; and FIG. 5 is a view in cross section on line V-V of FIG. 3.

DETAILED DESCRIPTION OF THE INVENTION

Figure 1:
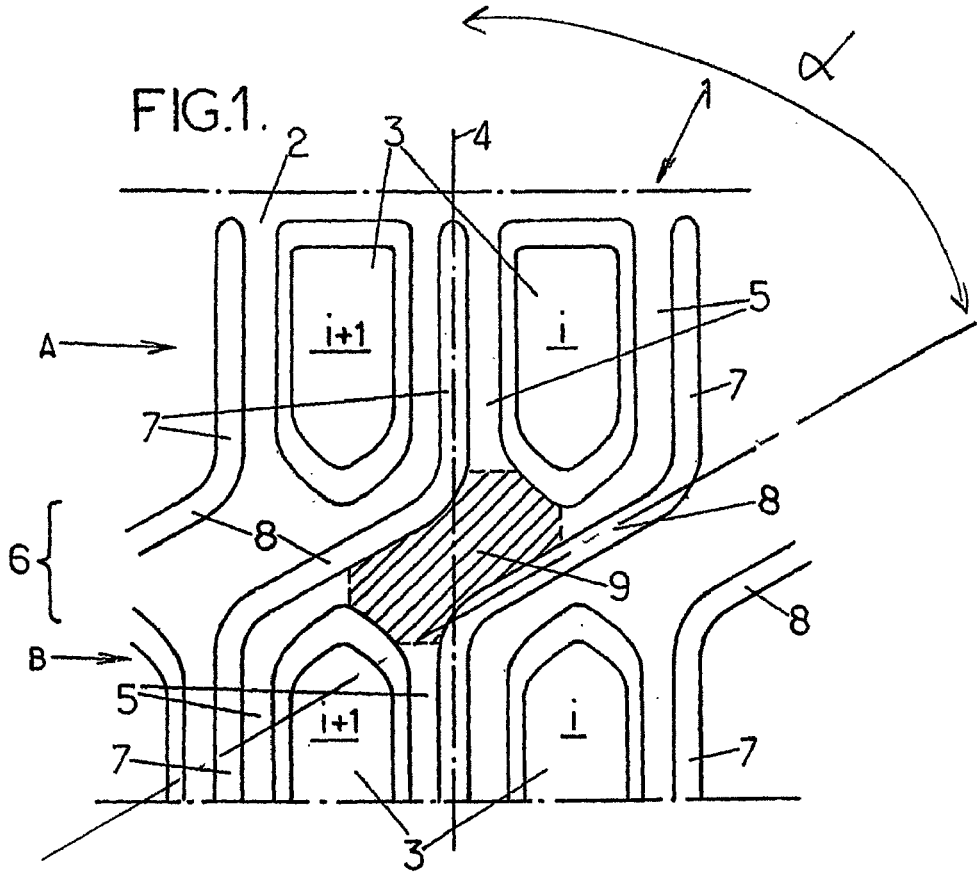
FIG. 1 is a flattened-out view of part of the body of a container configured according to the invention.

Referring first of all to FIG. 1, it shows part of the body 2, spread out flat, of a container 1 made of a thermoplastic such as PET, which can be filled with a hot liquid. The body 2 of this container 1 has a plurality of recessed panels 3 extending substantially parallel to the axis 4 of the body 2 and distributed in a substantially equidistant manner around the body, these panels 3 being separated by interposed portions of the body that form beams 5 extending substantially parallel to the axis 4.

According to the invention, the combination of the measures which follow is provided:

- the panels 3 are arranged around the body 2 on a number of levels A, B, . . . ;
- the panels of two consecutive levels A, B are separated by an annular portion of the body that forms a collar 6 substantially in surface continuity with the aforesaid beams 5;
- each beam 5 is recessed to form a longitudinal central channel section 7, and the channel sections 7 of the beams of the successive levels A, B, . . . are connected to one. another, in an angularly offset manner from a beam of one level (for example A in the configuration shown in FIG. 1) to the consecutive beam of the adjacent level B (situated below the level A in the example illustrated), by steeply inclined channel sections 8 extending in the aforesaid collars 6 and all inclined in the same direction substantially parallel to one another, in such a way that the body 2 is provided, right from top to bottom, with interconnected channel sections 7, 8. Thus, a number of connected sections form a channel configured as successive steps, and said channels are substantially parallel and distributed over the periphery of the body 2.

The presence of the inclined channel sections 8 in the collars 6 substantially reinforces these collars in the peripheral direction, a result which could not be obtained if the channels extended continuously from top to bottom of the body following the aligned beams of the successive levels. The container whose body is thus equipped is therefore provided with a controlled radial-deformation capability owing to the presence of the panels 3, which remain relatively small in area, and at the same time the collars 6 in intermediate regions of the body are reinforced, these collars thus helping maintain the general shape of the body 2 in conjunction with the shoulder and the base of the container.

In the simple arrangement shown in FIG. 1, the panels 3 of the various levels A, B, . . . are aligned in columns parallel to the axis 4 of the body 2. The channel sections 8, which are inclined from right to left in the downward direction in the configuration shown in FIG. 1, connect the channel sections 7 of the upper row A with the channel sections 7 of preceding rank in the underlying row B: for example, the channel section 7 of the row A that is situated between the panels of ranks i and i+1 is connected, by an inclined channel section 8, to the channel section 7 of the underlying row B that is situated between the panels of ranks i−1 and i, and so on.

Such an arrangement meets the practical requirements with regard to controlled deformability and, moreover, the configuration of the channels as successive steps (owing to the presence of a number of sections 7, 8 on each channel) winding their way between the panels provides a pleasant esthetic effect which is not possessed by the prior containers of the same type.

However, in the arrangement shown in FIG. 1, it will be noted that the inclined channel sections 8 have a peripheral extent corresponding to the width of a panel and approximately to the width of a column. The peripheral extent of these channel sections 8 is therefore relatively modest. In addition, the curvilinear polygonal region 9 (identified by hatching in FIG. 1) of each collar 6 contained between two successive channel sections 8 is relatively large, which means that these regions are at risk of being subject to unwanted deformations if the deformation forces become considerable.

Figure 2:
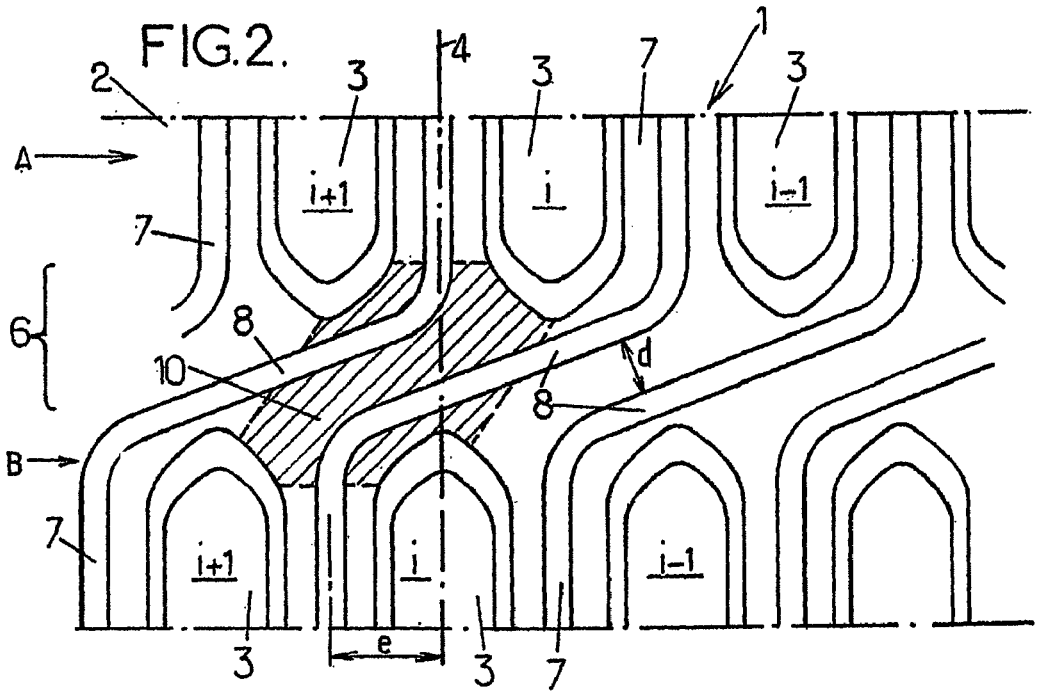
FIG. 2 is a flattened-out view of part of the body of a container configured according to a preferred embodiment of the invention.

To overcome this drawback, especially as regards containers intended to be filled with a very hot liquid, for example at a temperature of around 90-95° C., provision is made to implement a preferred variant embodiment of the preceding arrangements. As illustrated in FIG. 2, the panels 3 belonging to two consecutive levels A, B are angularly offset with respect to one another, this offset being denoted by e, such that a panel 3 of one level is situated at least partly opposite a beam 5 of the adjacent level; furthermore, the channel sections 8 of the collar 6 which is situated between these two levels A, B are inclined in the direction of the aforesaid angular offset e of the panels 3 of these two levels.

More precisely, the geometry of the channels, which was explained above, is retained; namely, for example, the channel section 7 situated in the row A between the panels i−1 and i is connected, by an inclined channel section 8, to the channel section 7 situated in the underlying row B between the panels i and i+1, and so on, with the difference that the distance between the beam 5 situated between the panels i−1 and i in the row A and the beam 5 situated between the panels i and i+1 in the underlying row B is greater here than in the embodiment shown in FIG. 1 in which panels are aligned parallel to the axis 4.

The arrangement shown in FIG. 2 offers a number of notable advantages over that shown in FIG. 1.

First of all, because of the separation created between the respective panels of same rank belonging to two consecutive rows A, B, the inclined channel sections 8 of the collars 6 have an increased length in the peripheral direction of the body.

Moreover, and most especially, it will be noted from FIG. 2 that each curvilinear polygonal region of a collar 6 that is contained between four neighboring panels (for example the region 10 between the panels of ranks i and i+1 in the row A and the panels of ranks i and i+1 in the row B, which is hatched in FIG. 2 to make it easier to identify) is crossed by two inclined channel sections 8 which are separated by a distance d which is substantially less than in the configuration shown in FIG. 1. This means that the channel sections 8 are more inclined than before and that, furthermore, portions of these two channel sections 8 extend one above the other over a distance corresponding to the offset e.

The combination of the increased length and the increased inclination of the channel sections 8, along with the closer spacing between said sections 8, means that each collar 6 has an undulating structure which increases its strength. Thus, the collars 6 are stronger at resisting the deformation forces to which they are subjected during the cooling of a liquid which is poured while very hot. It will also be noted that these same collars are able to better withstand the gripping force applied by a user's hand when taking hold of the container.

By way of example, FIG. 3 illustrates a container 1 in the form of a bottle featuring the arrangements explained above with regard to FIG. 2. In this example, the panels 3 are distributed over two levels A and B, and the aforesaid collar 6 is thus the only collar. The representation shown in FIG. 5, which is a section on line V-V of FIG. 3, that is to say a cross section of the container 1 shown in FIG. 3 through the collar 6, clearly reveals the undulating structure of the collar 6.

Furthermore, although the number of panels and beams may vary from one level to the other, the simplest solution consists in the panels and the beams being identical in number in all the levels. Moreover, again for reasons of simplicity, provision is made on each level for the panels 3, of which there are four in the example illustrated in FIG. 3, to alternate with an identical number of beams 5. It will be noted that, in the example illustrated, each panel 3 is provided with a central reinforcing rib 11 elongated substantially parallel to the axis 4.

The implementation of the measures according to the invention, resulting in the formation of mechanically reinforced annular regions in the body, makes it possible for containers to be produced that differ from the panel-type containers currently manufactured (containers of relatively small capacity, containers with a "squat" body shape). Thus, the container 1 illustrated in FIG. 3 has a shape with a relatively slender body while possessing the capability required to be able to be filled with a very hot liquid, at a temperature of 90-95° C.

Under these conditions, the inclined channel sections 8 of said collar 6 have an inclination $\alpha$ of between 40 and 90°, typically of approximately 70° in the example illustrated, with respect to the axis of the body 2. The representations depicted in FIGS. 4A and 4B, showing the bottle of FIG. 3 in a top view and a bottom view respectively, perfectly reveal the angular offset between the channel sections 7 of the upper row A (FIG. 4A) and the channel sections 7 of the lower row B (FIG. 4B).

In practice, it would appear that the number of panels in each level should be a minimum of three in order to obtain the expected results, and may amount to six to eight in the most common cases, or even more depending on the transverse size and the shape of the body of the container.

The invention claimed is:

1. A container made of thermoplastic which can be filled with a hot liquid, this container comprising a body having a plurality of recessed panels extending substantially parallel to the axis of the body and distributed in a substantially equidistant manner around the body, these panels being separated by portions of the body that form beams extending substantially parallel to the axis of the body, wherein the panels are arranged on a number of levels around the body;

the panels of two consecutive levels are separated by an annular portion of the body that forms a collar substantially in surface continuity with said beams;

each beam is recessed to form a longitudinal central channel section, and the channel sections of the beams of the successive levels are connected to one another, in an angularly offset manner from a beam of one level to the consecutive beam of the adjacent level, by strongly inclined channel sections extending in said collars and all inclined in the same direction substantially parallel to one another, in such a way that the body is provided, right from top to bottom, with channel sections which, connected together, form channels configured as substantially parallel successive steps and distributed over the periphery of the body, whereby the annular parts of the body that are constituted by said collars are mechanically reinforced against a crushing force due to the vacuum generated by the restriction in volume of the liquid as it cools.

2. The container as claimed in claim 1, wherein the panels of two consecutive levels are angularly offset such that a panel of one level is situated at least partly opposite a beam of the adjacent level, and wherein the channel sections of the collar which is situated between these two levels are inclined in the direction of said angular offset of the panels of the two levels.

3. The container as claimed in claim 1, wherein, on each level, the panels alternate with an identical number of beams.

4. The container as claimed in claim 1, wherein the panels are distributed over two levels, and in that said collar is the only collar.

5. The container as claimed in claim 4, wherein, on each level, the panels alternate with an identical number of beams, and wherein the inclined channel sections of said collar have an inclination of between 40 and 90° with respect to the axis of the body.

6. The container as claimed in claim 5, wherein the inclined channel sections of said collar have an inclination of approximately 70° with respect to the axis of the body.

7. A container for containing liquids, the container comprising:

a plurality of panels forming a circumferential first row of panels, wherein each panel in the first row of panels is separated from an adjacent panel in the first row of panels by a corresponding one of a plurality of first beams;

a plurality of panels forming a circumferential second row of panels below the first row of panels, wherein each panel in the second row of panels is separated from an adjacent panel in the second row of panels by a corresponding one of a plurality of second beams;

a circumferential collar separating the first row of panels from the second row of panels; and at least one channel extending in at least one first beam, the collar, and at least one second beam that is circumferentially offset from the at least one first beam.

8. The container according to claim 7, wherein a channel extends through each of the first beams and each of the of the second beams.

9. The container according to claim 8, wherein a portion of each channel that extends in a corresponding first beam and second beam is parallel to a vertical axis of the container; and wherein a portion of each channel extending through the collar is inclined with respect to the vertical axis of the container.

* * * * *